United States Patent [19]

Daly et al.

[11] 4,139,099

[45] Feb. 13, 1979

[54] SHRINK WRAPPING

[76] Inventors: Morgan A. Daly, 606 Washington St., Brookline, Mass. 02146; Paul R. Yager, 24 Pilgrim Rd., Newton, Mass. 02168

[21] Appl. No.: 813,793

[22] Filed: Jul. 8, 1977

[51] Int. Cl.[2] ..... B65D 65/02; B65D 69/00

[52] U.S. Cl. ..... 206/575; 40/158 R; 206/497

[58] Field of Search ..... 40/158 R, 158 A, 158 B; 206/497, 575; 229/DIG. 12; 35/8 R, 26

[56] References Cited

U.S. PATENT DOCUMENTS

| | | | |
|---|---|---|---|
| 3,188,762 | 6/1965 | Morrill | 40/158 R |
| 3,390,474 | 7/1968 | Wright | 40/158 R |
| 3,468,412 | 9/1969 | Forman | 206/497 |
| 3,581,423 | 6/1971 | Mascolo | 40/158 R |
| 3,677,399 | 7/1972 | Tatar | 206/497 X |
| 3,766,676 | 10/1973 | Slemmons | 40/158 A |
| 3,809,311 | 5/1974 | Fohrman et al. | 206/497 X |

*Primary Examiner*—Steven E. Lipman
*Attorney, Agent, or Firm*—Charles Hieken

[57] ABSTRACT

A kit for shrink wrap framing includes a light rigid backing board having one face coated with positionable pressure-sensitive mounting adhesive and a release sheet, a rectangular shrink-wrap envelope about ¼ inch larger than the backing board on all four sides, with a 1-inch flap along one short side coated with pressure sensitive adhesive and a release strip, plastic corner reinforcements and double-faced foam suqares or foam tape. The user peels the release sheet from the face of the board, presses the artwork to be mounted against the exposed adhesive area, inserts the plastic corner reinforcements into the four corners of the board, inserts the board into the shrink film envelope, removes the release paper frpom the envelope flap, seals the envelope flap and exposes the assembly to heat, such as from a gun-type hair dryer until the shrink film is tightly wrapped around the enclosed assembly.

8 Claims, 5 Drawing Figures

SHRINK WRAPPING

BACKGROUND OF THE INVENTION

The present invention relates in general to shrink wrapping and more particularly concerns novel apparatus and techniques for economically, easily and neatly mounting artwork and other generally flat items in a manner that requires relatively little skill, and tools normally readily available to many people.

Shrink wrapping is well-known and ordinarily involves relatively expensive equipment, such as commercial heat sealing equipment, hot air blowers or heating chambers. Shrink wrapping is commonly used for protecting artwork. The typical prior art approach involves mounting the artwork on a board, placing the mounted artwork between two sheets of shrink film unwound from a roll, heat-fusing the opposed sheets together along all four edges of the artwork, thereby cutting away the surrounding film and then applying hot air with a commercial heat gun to bring the wrap tautly about the artwork. It is also known to heat shrink articles by placing them in a bag and heating the assembly as described in U.S. Pat. No. 4,018,337.

It is an important object of this invention to provide improved shrink wrapping.

It is another object of the invention to achieve the preceding object in a manner that enables an individual to neatly, easily and economically shrink wrap artwork.

It is another object of the invention to achieve the preceding object with an economical kit requiring relatively little skill or equipment to neatly shrink wrap.

It is a further object of the invention to achieve one or more of the preceding objects for neatly packaging artwork in a protective package that enhances the appearance of the artwork.

It is a further object of the invention to achieve one or more of the preceding objects while providing a convenient means for wall mounting.

SUMMARY OF THE INVENTION

According to the invention, there is mounting board means having a face coated with adhesive means for securing artwork to the mounting board means, shrink wrap envelope means slightly larger than the mounting board means formed with a flap along one side for enclosing the mounting board means with artwork attached and means for sealing the envelope flap to the envelope means, such as pressure sensitive adhesive means. Preferably there are corner reinforcing means formed with a gusset for attachment to the corners of the mounting board means for protecting the corners. The width of the corner reinforcing means is preferably no greater than the thickness of the mounting board means so that it may be pressed into the corners of the mounting board means flush with the edges of the mounting board means to protect corners while being invisible from the front. Preferably there are double-faced adhesive elements for attachment to the rear of a shrink-wrapped mount for mounting the assembly on a wall.

According to one aspect of the invention the shrink film means is in the form of an envelope having a flap carrying a pressure sensitive adhesive, comprising means for sealing the shrink wrap film about the mounting board means. According to another aspect of the invention, the edges of a single sheet of shrink wrap film means are wrapped around to the rear of the mounting board means, and adhered by means of pressure sensitive adhesive on the rear face of the board means. This edge sealing with a pressure sensitive adhesive or other suitable adhesive or by using a fold in the shrink wrap film without applying heat to effect a seal along the edge may be termed cold sealing means.

According to the method of the invention, artwork is mounted to the front of the mounting board means, preferably the corner reinforcing means seated in the corners of the mounting board means, the shrink wrap means is arranged to cover at least the front surface and sealed about the edges of the mounting board means, and heat is applied to the assembly to tighten the shrink wrap means about the mounting board means.

Numerous other features, objects and advantages of the invention will become apparent from the following specification when read in connection with the accompanying drawing in which:

DETAILED DESCRIPTION OF PREFERRED EMBODIMENTS

Figure 1:
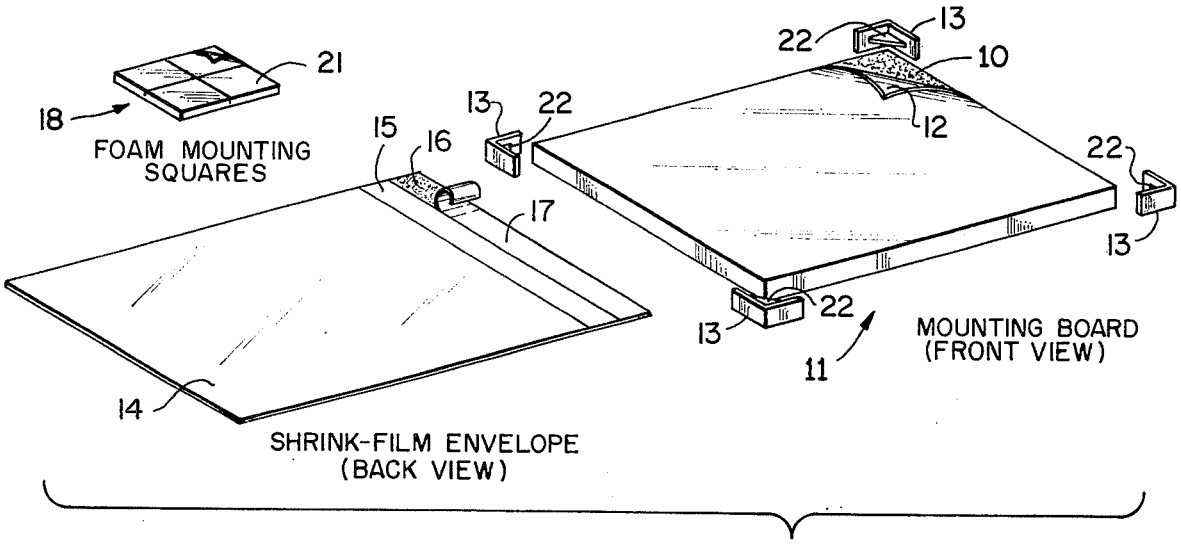
FIG. 1 is an exploded view of typical components of a kit according to the invention.

With reference now to the drawing and more particularly FIG. 1 thereof, there is shown an exploded view of typical components of a kit according to the invention. The kit includes a mounting board 11 having a release sheet 12 covering pressure sensitive positionable adhesive 10, four plastic corner pieces 13, a shrink film envelope 14 having a flap 15 with pressure sensitive adhesive 16 covered by release strip 17 and four foam mounting squares 18 having pressure sensitive adhesive on both sides covered by release paper 21, one side of which is visible in FIG. 1. Flap 15 could be fastened by other means, such as a strip of double-faced adhesive tape.

The invention is typically used in the following manner. Peel release sheet 12 from mounting board 11, thereby exposing positionable pressure sensitive adhesive 10. Mount the work of art or other document on pressure sensitive adhesive 10. If desired, mounting board 11 may be trimmed to the size of the artwork. Push plastic corner pieces 13 into mounting board 11 so that the gussets 22 dig into the corners of mounting board 11 centered therein so that corner pieces 13 have a width equal to or slightly less than the thickness of mounting board 11 protecting the corners. Then insert mounting board 11 into envelope 14 so that the work of art or other document adhered to pressure sensitive adhesive 10 faces the front surface from which flap 15 extends. Then remove release strip 17, and fold flap 15 over so that pressure sensitive adhesive 16 adheres smoothly to the back face of shrink film envelope 14 exposed in FIG. 1. Then expose the assembly to heat, such as from a blower of the type that could be used for hair drying. The assembly might also be placed in an oven or heated with a clothes iron through a protective material. Preferably heat the back first to pull seams around out of view before applying heat to the front.

The step of applying heat occurs until the film shrinks tightly around the mounting board, thereby neatly framing, mounting and protecting the work of art or other document thus mounted. Then remove a release paper 21 from one side of the foam mounting squares, attach the four squares to the corners of the back of the assembly, remove the other release paper from each of the foam mounting squares and press the assembly against a wall, thereby neatly displaying the packaged work of art or other document.

Various materials may be used in accordance with the invention. Preferred mounting boards include those made of a sandwich of styrofoam between paper, such as "Fome-Cor" board manufactured by the Monsanto Company or other light rigid backing board, typically 3/16 inch thick for normal-size works of art and ½ inch thick for poster size. Preferably the mounting boards are cut in a range of standard sizes corresponding to commonly used art papers. The front face of the mounting board is coated with positionable mounting adhesive 10, such as 3M No. 567 and a release sheet 12.

The shrink wrap envelope 14 is preferably rectangular and about ¼ inch larger than the associated mounting board 11 on all four sides. 150 gauge shrink film is preferred for normal size mounts such as W. R. Grace "Cryovac", Reynolds "Reynolon" and DuPont "Clysar", other films and thicknesses being useable, preferably thinner for small mounts and heavier for posters and heavier mounts.

Flap 15 is typically one inch wide and coated with pressure sensitive adhesive 16 and release strip 17 comprising, for example, 3M adhesive transfer tape No. 924. It may be advantageous to have adhesive coatings on flap 15 as shown and on the back surface of envelope 14 for an especially tight contact bond.

Plastic corner reinforcements 13 function to protect mounting board 11 against pinching or crushing during the shrink wrapping operation and handling and are equal-leg rigid plastic angles preferably with gusset 22 for extra strength, the legs typically being one inch long and of width preferably substantially equal to the thickness of mounting board 11 or slightly less so the corner piece may be pressed into the foam flush with the edges of the board and become invisible in front view.

The foam square 18 may be 3M mounting squares having pressure sensitive adhesive on both sides covered by a release paper.

Figure 2:
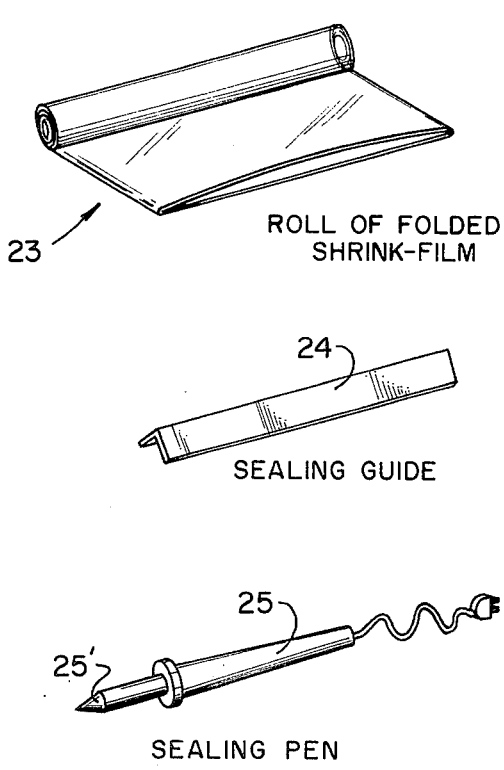
FIG. 2 is a view of another kit according to the invention especially useful for bulk users.

Referring to FIG. 2, there is shown an alternate embodiment of the invention that may be especially useful for the bulk user, comprising a roll of center-folded shrink film 23, a right-angle aluminum bar 24 functioning as a sealing guide, a sealing pen 25 which may typically be an electrically heated tool. The kit may also include the foam mounting squares 18 shown in FIG. 1 and one or more mounting boards.

Figure 3:
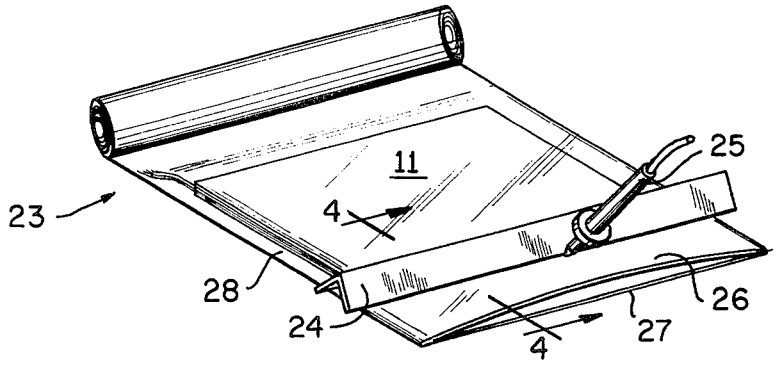
FIG. 3 is a perspective view illustrating how the kit of FIG. 2 may be used according to the invention.
Figure 4:
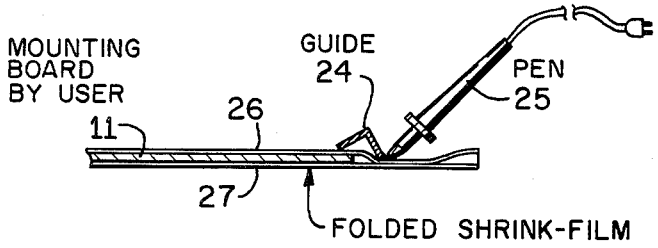
FIG. 4 is a sectional view through section 4-4 of FIG. 3.

Referring to FIGS. 3 and 4, there is shown a perspective view of the kit of FIG. 2 being used, FIG. 4 being a sectional view through section 4—4 of FIG. 3.

The art mount may be prepared as described above using a pre-adhesive-coated mounting board 11 or by taping, cementing or dry-mounting on regular Fome-Cor or other stock mounting boards, using the reinforcing plastic corners 13 is desired. The mounted artwork is then slipped into place between two plies of film 26 and 27, preferably with one edge tight against center fold 28. Then sealing guide 24 is placed successively over each of the three other covered edges of mounting board 11, and sealing pen 25 drawn along sealing guide 24 to seal the remaining three edges along lines about ¼ inch outside the edge of the mount and effect cutting along the sealed edge. Heat is then applied to the package in the manner described above with a hair dryer, iron, oven or other suitable means.

Roll 23 may be regular center-fold double-ply film, typically 150 gauge in a variety of widths and lengths typically from 12 inch to 36 inch in width and 25 to 100 feet in length. Edge sealing pen 25 may be a simple electric heating tool with proper heat characteristics and preferably with a blunt conical tip. The tip 25' may be Teflon coated to help prevent adhering of the shrink film. Edge sealing guide 24 may be stock 1 inch × 1 inch × 1/16 inch extruded aluminum angle molding that may be 18 inch to 24 inch long.

Figure 5:
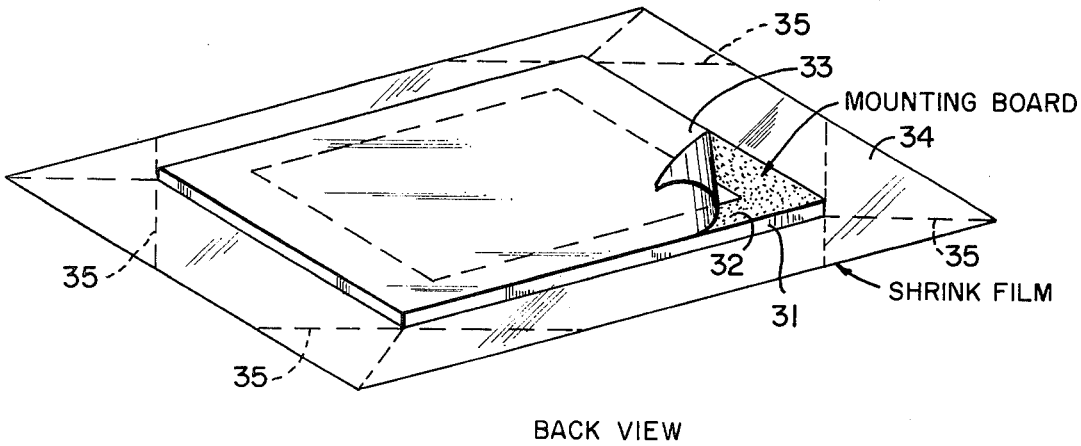
FIG. 5 is still another embodiment of a kit according to the invention.

Referring to FIG. 5, there is shown still another embodiment of the invention having a mounting board 31 with its front surface (not visible) having positionable pressure sensitive adhesive 10 covered by a release sheet 12 as in FIG. 1 but also having pressure sensitive adhesive 32 covered by release sheet 33 on the rear surface and a single sheet of shrink film 34 slightly larger in area than the area of mounting board 31. Mounting board 31 is first prepared as described above in connection with the embodiment of FIG. 1. Instead of putting art-mount 31 into an envelope, a 1 inch strip of release sheet 33 is cut and removed around perimeter of the mount, it is placed in front face down on shrink film sheet 34 in the center and the edges of shrink film 34 are wrapped about board 31 in contact with pressure sensitive adhesive 32. The assembly is then exposed to heat in the manner described above. It may be advantageous to initially cut off diagonally the corners 35 of shrink film 34.

A technique for preparing the embodiment of FIG. 5 may involve using relatively large stock sizes of mounting board, such as 30 inch × 40 inch having a front face coated with pressure sensitive adhesive and a release sheet as described above, with the back face carrying an adhesive coating of a type for bonding with the shrink film and another release sheet, and separately, a single sheet of shrink film several inches larger than the mounting board. The board may be used for mounting a number of documents by cutting and peeling the front release sheet at a corner of the board to expose an adhesive area the same size as the artwork, adhering the artwork smoothly to the front face, and then cutting out this piece of board to the edge of the artwork to form board 31, the remainder of the board remaining for future use. An ordinary mat knife and the sealing guide may be used for this cutting. The plastic corner reinforcements 13 may be inserted as described above. Then cut and peel a strip of the back release sheet around all four sides of the board 31 to expose a 1 inch border of adhesive 32 around the perimeter of the rear face of the mount. Then cut a piece of shrink film 34 about 1 inch larger on all sides than the art mount, cut off the corners 35 at a 45° angle so that the art mount board 31 fits just inside the diagonal corners as shown. Center the mount on the film sheet 34 as shown, face down, with four edges of film projecting beyond the mount as shown, and proceed as described above.

The shrinking is preferably accomplished by applying heat with a gun-type hair dryer or blower or with a clothes iron through a Handywipe cloth or other suitable material for moderating and diffusing the heat. It is preferred that heat be directed to the rear face first to pull the seams around to the back, out of view.

There has been described novel apparatus and techniques for economically and neatly displaying and protecting artwork and other documents. It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. Shrink wrapping kit apparatus readily assembleable by an individual of ordinary skill into a neatly sealed and shrink-wrapped package for mounting, protecting and displaying a graphic work without the use of the usual edge sealing and heat shrinking equipment, said apparatus comprising, mounting board means for carrying a graphic work to be protected and displayed, a source of shrink film means for covering all the edges of said mounting board, and means for sealing said shrink film about all the edges, with the edge sealing means being solely of the group consisting of cold sealing means, a sealing guide, and a fixed-tip hand-held movable heat pen, wherein said shrink film means may be edged sealed about said board means by moving said heat pen along said guide which is pressed down over the shrink film means outside a respective edge of the graphic material.

2. Shrink wrapping kit apparatus in accordance with claim 1 wherein said shrink film means comprises a roll of 2-ply center-fold film folded over along one edge and open at the other.

3. Shrink wrapping kit apparatus in accordance with claim 1 wherein said shrink wrap film means is a single sheet and pressure sensitive adhesive is positioned on the rear surface of said mounting board means.

4. Shrink wrapping kit apparatus in accordance with claim 1 wherein said shrink wrap film means is a preassembled envelope of area slightly larger than that of said mounting board and having an opening along one edge for receiving said mounting board means and a flap adjacent to said opening for being folded over and covering said opening.

5. Shrink wrapping kit apparatus in accordance with claim 3 and further comprising pressure sensitive adhesive means for securing said flap to said envelope.

6. Shrink wrapping apparatus in accordance with claim 1 wherein said mounting board means comprises positionable pressure sensitive adhesive and a release sheet thereon.

7. Shrink wrapping kit apparatus comprising, mounting board means for carrying a graphic work to be mounted, protected and displayed, a source of shrink film means for covering all the edges of said mounting board, means for sealing said shrink film about all the edges, corner reinforcing means for attachment to the corners of said mounting board means for protecting the corners thereof formed with means for attachment to the corners of said mounting board means with the width of each corner reinforcing means no greater than the thickness of said mounting board means so that each corner reinforcing means may be pressed into the corners of said mounting board means flush with the edges of said mounting board means to protect the corners while being invisible from the front of said mounting board means.

8. Shrink wrapping apparatus in accordance with claim 7 wherein each corner reinforcing means is formed with a gusset for attachment to the corners of said mounting board means.

* * * * *

UNITED STATES PATENT OFFICE

CERTIFICATE OF CORRECTION

PATENT NO. : 4,139,099
DATED : Feb. 13, 1979
INVENTOR(S) : Morgan A. Daly and Paul R. Yager It is certified that error appears in the above-identified patent and that said Letters Patent are hereby corrected as shown below:

In the ABSTRACT, line 8, spell "squares" correctly.
Line 14, spell "from" correctly.

Column 3, line 63, change "is" to --if--.

Column 4, line 28, cancel "in".

Column 6, line 11, change "3" to --4--.

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*